US005147052A

United States Patent [19]

Minette

[11] Patent Number: 5,147,052

[45] Date of Patent: Sep. 15, 1992

[54] CHILD RESISTANT CLOSURE

[75] Inventor: Jeffrey C. Minette, Evansville, Ind.

[73] Assignee: Sunbeam Plastics Corporation, Evansville, Ind.

[21] Appl. No.: 769,928

[22] Filed: Sep. 30, 1991

[51] Int. Cl.[5] ..... B65D 55/02

[52] U.S. Cl. ..... 215/215; 215/219; 215/220; 215/302; 215/330

[58] Field of Search ..... 215/203, 204, 208, 215, 215/218, 219, 220, 301, 302, 330, 334

[56] References Cited

U.S. PATENT DOCUMENTS

| | | | |
|---|---|---|---|
| 2,921,705 | 1/1960 | Dorsey | 215/9 |
| 3,097,756 | 7/1963 | Dorsey | 215/215 |
| 3,164,277 | 1/1965 | Reading | 215/215 |
| 3,396,864 | 8/1968 | Jones et al. | 215/215 |
| 3,679,085 | 7/1972 | Gach | 215/9 |
| 3,685,676 | 8/1972 | Gach et al. | 215/9 |
| 3,705,662 | 12/1972 | Gach | 215/9 |
| 3,716,161 | 2/1973 | Julian et al. | 215/9 |
| 3,722,727 | 3/1973 | Gach | 215/9 |
| 3,830,390 | 8/1974 | Gach | 215/9 |
| 3,892,325 | 7/1975 | Maguire | 215/219 |
| 3,951,290 | 4/1976 | Montgomery | 215/219 |
| 3,977,554 | 8/1976 | Costa | 215/220 |
| 4,011,960 | 3/1977 | Mauvernay et al. | 215/220 |
| 4,156,491 | 5/1979 | Lyon | 215/302 |
| 4,353,474 | 10/1982 | Luker | 215/220 |
| 4,364,484 | 12/1982 | Kinsley | 215/220 |
| 4,371,088 | 2/1983 | Gach | 215/220 |
| 4,394,916 | 7/1983 | Smalley | 215/220 |
| 4,469,235 | 9/1984 | Parker | 215/295 |
| 4,641,759 | 2/1987 | Kelley | 215/220 |
| 4,673,095 | 6/1987 | Pureservic et al. | 215/220 |
| 4,731,512 | 3/1988 | Barriac | 215/220 |
| 4,775,061 | 10/1988 | Coote | 215/215 |

FOREIGN PATENT DOCUMENTS 3011401 3/1979 Fed. Rep. of Germany .

*Primary Examiner*—Stephen Marcus
*Assistant Examiner*—Vanessa Caretto
*Attorney, Agent, or Firm*—Gifford, Groh, Sprinkle, Patmore and Anderson

[57] ABSTRACT

A two-piece child resistant closure having projections on the top of the inner cap. These projections are accessible through the open center of the outer cap top to assist the user in unthreading the container. This provides a user friendly closure for the elderly and arthritically impaired while still maintaining the usual child resistant opening feature, which can, for example, require a simultaneous push and turn movement.

13 Claims, 1 Drawing Sheet

CHILD RESISTANT CLOSURE

BACKGROUND OF THE INVENTION

1. Field of the Invention

This invention relates to a threaded child resistant closure. More particularly, this invention relates to a two-piece child resistant closure.

2. Related Prior Art

There is a large variety of threaded child resistant closures utilizing a two-piece cap in which an inner cap threads onto the container neck, and an outer cap contains the inner cap in a nested relationship. The outer cap is manipulated to engage the inner cap so that when the outer cap is turned the inner cap is threaded onto or unthreaded from the container neck. There may be separate engaging elements on the inner and outer caps for unthreading or opening the closure and separate elements on the inner and outer caps for closing or threading the closure onto the container neck. These opening and closing elements may also be combined, and various devices can be used to allow freewheeling of the outer cap in the unthreading direction until the outer cap is manipulated to engage the inner cap.

A number of these closures require the simultaneous pushing or pulling of the outer cap toward or away from the inner cap and container neck while a rotary motion is applied to the cap. Other closures require simultaneous squeezing when unthreading.

Typically, threading the closure onto the container neck requires little or no manipulation or axial thrust to be exerted on the outer cap. When the outer cap is rotated in an unthreading direction without the impartation of an axial thrust, it freely turns with respect to the inner cap and container neck. This freewheeling can be created in the drive mechanism between the caps with a ramp element on one of the caps over which the engagement element on the other cap rides in the unthreading direction. Simultaneously application of an axial force to the outer cap while turning engages these elements or other elements to impart an unthreading torque to the inner cap.

U.S. Pat. Nos. 3,705,662; 3,830,390; 4,353,474 and 4,371,088 are examples of precision molded, two-pieced push and turn child resistant closures to which the features of the present invention can be directed. Like many child resistant closures, moderate force must be used to engage the off drive, and when the closure has been solidly closed, considerable rotational torque may also be needed. With an elderly or arthritically impaired adult, such an impartation of force and/or the exercise of special dexterity can be extremely vexatious or impossible. It is to the solution of this problem that the present invention is directed.

SUMMARY OF THE INVENTION

The present invention is directed to a two-piece resistant closure for a container having a threaded neck in which means is provided to assist or facilitate the application of turning torque to the closure. The invention provides a means for unthreading the inner cap with or without engagement of the drive means between the outer cap and the inner cap. In most cases when the features of the invention are being used, the application of turning torque will be directly to the inner cap without engagement of the outer cap, and this can be accomplished by the use of a simple tool requiring much less force than that required for normal engagement. The invention can also provide an extended area on the top of the inner cap for palm engagement unthreading. The application of the invention to the closure in no way effects the conventional push and turn or squeeze and turn unthreading which will still be used in most cases.

The invention utilizes a two-piece closure in which the outer driver cap has an open center top and a skirt within which the inner cap is retained. Raised engagement means is provided on the top of the inner cap accessible through the open center of the outer cap which permits unthreading of the closure whether or not the closure unthreading drive is engaged. This raised engagement means will normally include diametrically opposed projections which can be engaged by a simple tool such as a pencil to permit unthreading rotation of the inner cap relative to the container. These projections can take the form of cylindrical bosses or other configurations providing a radially extending surface which is engagable by the tool. An array of a combination of projections can be used across the top of the inner cap to provide a decorative appearance and to provide an extended surface which can be engaged by the palm of the user in order to exert a force directly on the inner cap to unthread the closure without the use of a tool. The top of the outer driver cap is constructed as a flange having an exterior surface which extends from the periphery of the outer driver cap skirt inwardly to the open center. This flange can be recessed in diametrically opposed areas which can aligned with the opposed projections for tool access across the top of the outer cap. These recesses are wider or of greater arcuate extent than the width of the tool to be used or the arcuate offset of the diametrically opposed projections which will be engaged by the tool. In most instances, when a tool is used, the inner cap will be unthreaded while the outer cap remains freewheeling.

BRIEF DESCRIPTION OF THE DRAWING

The advantages of the present invention will be more apparent from the following detailed description when considered in connection with the accompanying drawing wherein.

DETAILED DESCRIPTION OF THE PREFERRED EMBODIMENTS OF THE INVENTION

Figure 1:
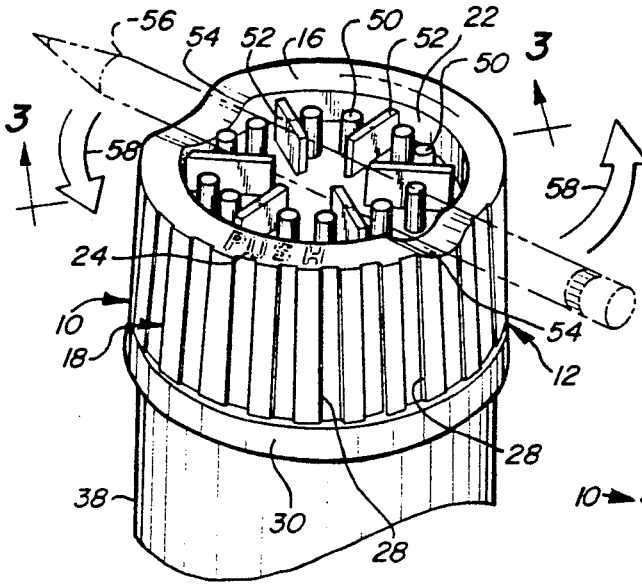
FIG. 1 is a perspective view of the closure of this invention applied to a container neck, showing a tool in the form of a pencil in phantom engaged with projections on the inner cap top and showing by arrows the direction of unthreading.

Closure 10 embodying the present invention includes two parts, an outer driver cap 12 and an inner cap 14.

Outer cap 12 has an open center top 16 and a skirt 18 terminating in an inwardly directed bead 20. Top 16 is formed as a flange extending from the periphery of skirt 18 inwardly to open center 22. The flange top 16 of the outer cap may also have indicia indicating how to open the closure such as the word "push" indicated at 24 and the word "open" with an arrow indicated at 26. Outer cap skirt 18 may also have ribs 28 furnishing a gripping surface for turning the cap and a lower scuff band 30.

Inner cap 14 has a top 32 and a skirt 34 containing internal threads 36 for threading on external threads 39 of container neck 38. Inner cap 14 is snapped passed bead 20 into nesting relationship with the outer cap 12. Sufficient axial clearance at 40 is maintained to permit movement of the inner cap axially relative to the outer cap 12. Inner cap 14 has a number of evenly spaced lugs 42 located at the periphery of top 32. Each lug has a ramp or cam surface 44 and an axially extending on-drive surface 46. Outer cap 12 has number of depending axially extending ribs 48 corresponding to the number of lugs 42. Inner cap 14 fits firmly but loosely in outer cap 12 so that when the closure 10 is put on the container neck 38, the outer cap slips downwardly on the inner cap 14 so that ribs 48 will engage the on-drive surfaces 46 of lugs 42. Normal turning torque will firmly seat the inner cap on the container neck, the internal threads 36 of inner cap 14 engaging threads 39 on the container neck. If the outer cap 12 is turned in a counter clockwise unthreading direction, the ribs 48 will merely climb the ramp surfaces 44 leaving the inner cap firmly threaded on the container neck. In order to unthread the closure, downward pressure must be applied to the top 16 of the outer cap while it is being rotated in a counter clockwise direction. This will keep the ribs 48 engaged with the ramp surfaces 44 so that they will not climb over these surfaces, and the inner cap will be unthreaded.

Figure 2:
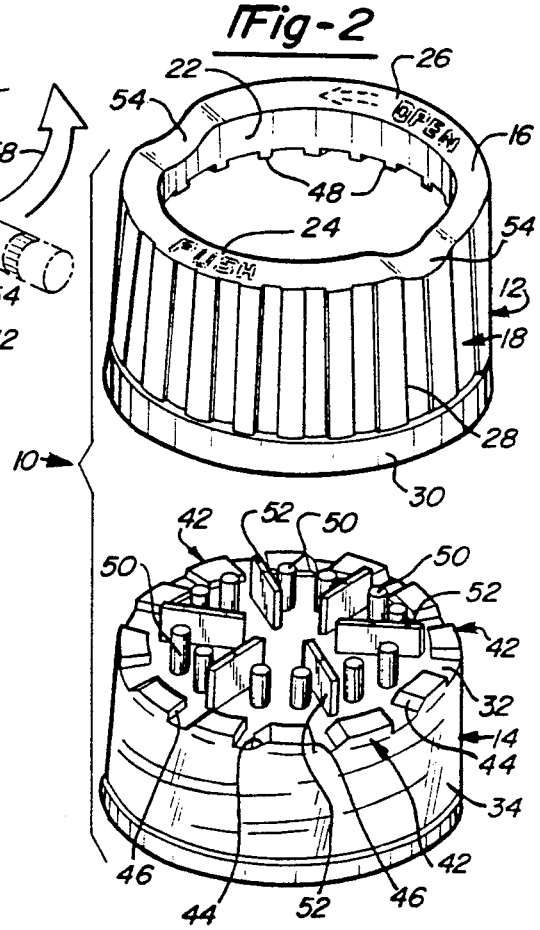
FIG. 2 is an exploded perspective view showing how the outer driver cap is assembled to the inner cap.
Figure 3:
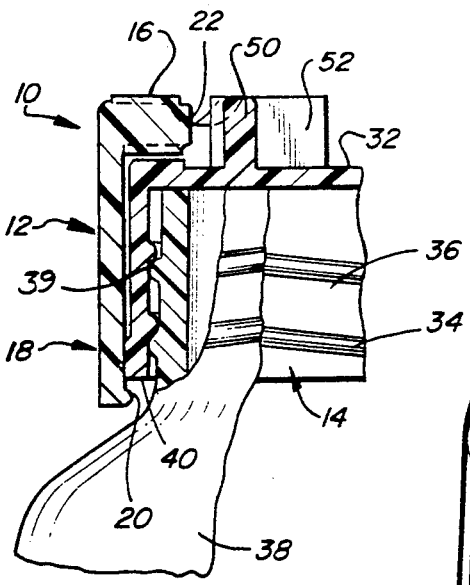
FIG. 3 is a partial elevational view in cross section taken along line 3—3 of FIG. 1.

As seen in FIGS. 1–3, the top 32 of inner cap 14 is provided with a number of cylindrical projections 50 and rectangular bar projections 52. Projections 50 and 52 extend upwardly to a point slightly below the top surface 16 of the outer cap so that they may not be gripped by a child's teeth. The user, however, can easily engage the palm of his hand with these projections through the open center 22 of the outer cap 12 so that unthreading torque can be applied directly to the inner cap with or without the ribs 48 engaging the ramp surfaces 44, and, in this way, the user can unthread the closure 10 without the application of a downward force.

Diametrically opposed recesses 54 are provided in the outer cap top 16 so that they can be aligned with pairs of cylindrical projections 50 or bar projections 52. A tool such as a simple pencil 56 can then be inserted across the top 16 to engage the projections to easily unthread the closure 10 by rotation in a counter clockwise direction as shown by arrows 58. FIG. 1 shows the pencil engaging cylindrical projections 50, but the recesses 54 may be aligned so that the bar projections 52 can be similarly engaged. Projections 50 and 52 may take other shapes and distribution patterns which will be equally effective for applying a unthreading torque directly to the inner cap 14.

Figure 4:
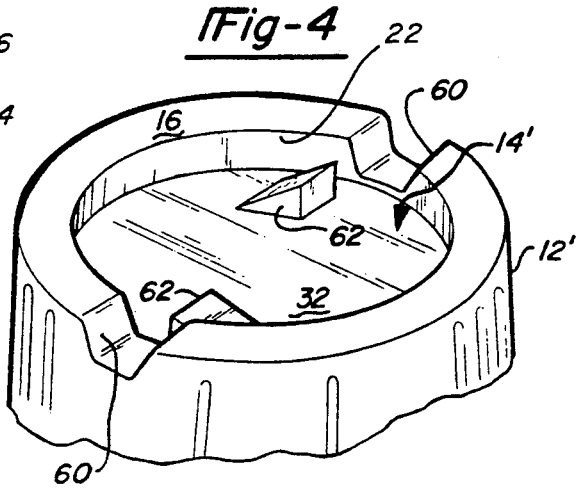
FIG. 4 is a partial perspective view showing an alternative presentation of projections on the top of the inner cap.

As shown in FIG. 4, outer cap 12' has a pair of diametrically opposed recesses 60, and the inner cap 14' has a single pair of triangular shaped projections 62 which can be engaged by a simple tool such as the pencil 56 shown in FIG. 1. The arcuate extent of recesses 54 and 60 is large enough so that the tool will not drivingly engage the outer cap but will freely move with the unthreading of the inner cap.

The embodiments of the invention in which an exclusive property or privilege is claimed are defined as follows:

1. A two-piece child restraint closure for a container having a threaded neck comprising, in combination:

an inner cap having a top and a skirt depending from the periphery of said top with internal threads for engaging the threaded container neck;

an outer driver cap having an open center top and a skirt depending from the outer periphery of said top within which said inner cap is retained;

drive means on said inner and outer cap allowing the closure to be threaded onto the container neck by rotation of the outer cap but allowing the outer cap to rotate freely in an unthreading direction until the outer cap is manipulated to drivingly engage the inner cap; and engagement means including diametrically opposed projections on the top of the inner cap accessible through the open center of the outer cap which projections can be engaged to permit unthreading rotation of the inner cap relative to said container whether or not said drive means is engaged.

2. The closure according to claim 1 wherein said open center top includes a flange having an exterior surface extending from the periphery of said outer driver cap skirt inwardly to said open center, and said flange is recessed in diametrically opposed areas which can be aligned with said opposed projections for tool access across the open center top of said outer driver cap.

3. The closure according to claim 2 wherein said opposed projections extend upwardly from the top of said inner cap to a point below the exterior surface of said flange.

4. The closure according to claim 1 wherein said projections include cylindrical bosses.

5. The closure according to claim 1 wherein said projections include bosses having radially extending surfaces engageable by said tool.

6. The closure according to claim 1 wherein said drive means is structured so that pressure must be applied to said outer cap to drivingly engage the inner cap.

7. The closure according to claim 6 wherein said drive means include lugs on one of said inner and outer caps and ribs on the other of said inner and outer caps, and wherein when said outer cap is being rotated to thread said closure onto a container neck, the ribs will engage an axial drive surface on each of said lugs, and when said outer cap is rotated in an unthreading direction, said ribs will slide over a ramp surface on each of said lugs until said outer cap is depressed to drivingly engage said ribs with said ramp surfaces.

8. A push and turn two-piece child resistant closure for a container having a threaded neck comprising, in combination:

an inner cap having a top and a skirt with internal threads for engaging the threaded container neck;

an outer drive cap having an open center top and a skirt within which said inner cap is retained;

closing drive means on said inner and outer caps allowing the closure to be threaded onto the container neck by rotation of the outer cap;

freewheeling means on said inner and outer caps allowing the outer cap to rotate freely in an unthreading direction;

opening drive means on said inner and outer cap including means allowing manipulation of said outer cap to drivingly engage the inner cap; and engagement means including a plurality of projections distributed over the top of the inner cap presenting an extended area accessible for engagement by a user through the open center of the outer cap which permits unthreading of the closure whether or not said opening drive means is engaged.

9. The closure according to claim 8 wherein said closing drive means includes lugs on one of said inner and outer caps and ribs on the other of said inner and outer caps, and wherein when said outer cap is being rotated to thread said closure onto the container neck, said ribs will engage an axial drive surface on each of said lugs.

10. The closure according to claim 8 wherein said freewheeling means includes lugs on one of said inner and outer caps and ribs on the other of said inner and outer caps, and wherein when said outer cap is rotated in an unthreading direction, said ribs will cam over a ramp surface on each of said lugs allowing the outer cap to rotate freely in the unthreading direction without unthreading said inner cap.

11. The closure according to claim 8 wherein said opening drive means includes lugs on one of said inner and outer caps and ribs on the other of the said inner and outer caps, and wherein when said outer cap is being rotated in an unthreading direction as said outer cap is held depressed, said ribs will drivingly engage an off drive surface on each of said lugs.

12. The closure according to claim 8 including lugs on one of said inner and outer caps and ribs on the other of said inner and outer caps, and wherein when said outer cap is being rotated to thread said closure onto the container neck, said ribs will engage an axial drive surface on each of said lugs, when said outer cap is being rotated in an unthreading direction, without depressing said outer cap, said ribs will cam over ramp surfaces on said lugs allowing said outer cap to freely rotate without unthreading said inner cap, and when said outer cap is rotated in an unthreading direction while being depressed, said lugs will engage said ramp surfaces unthreading said inner cap from the container neck.

13. A two-piece child resistant closure for a container having a threaded neck comprising, in combination:

an inner cap having a top and a skirt with internal threads for engaging the threaded container neck;

an outer driver cap having an open center top and a skirt within which said inner cap is retained;

drive means on said inner and outer cap allowing the closure to be threaded onto the container neck by rotation of the outer cap but allowing the outer cap to rotate freely in the unthreading direction until the outer cap is manipulated to drivingly engage the inner cap; and engagement means including a plurality of projections distributed over the top of the inner cap presenting an extended area accessible for manual engagement of a user through the open center of the outer cap which permits unthreading of the closure whether or not said drive means is engaged.

* * * * *

UNITED STATES PATENT AND TRADEMARK OFFICE

CERTIFICATE OF CORRECTION

PATENT NO. : 5,147,052

DATED : September 15, 1992

INVENTOR(S) : Jeffrey C. Minnette

It is certified that error appears in the above-identified patent and that said Letters Patent is hereby corrected as shown below:

On the title page, Items [19] and [75],

Patentee's last name is spelled incorrectly on the cover page of the patent. The correct spelling is "Minnette".

Column 1, line 57, "two-piece resis-" should read "two-piece child resis-".

Signed and Sealed this

Seventh Day of December, 1993

*Attest:*

*Attesting Officer*

Bruce Lehman

BRUCE LEHMAN

*Commissioner of Patents and Trademarks*